United States Patent [19]

Stanek et al.

[11] Patent Number: 4,634,345

[45] Date of Patent: Jan. 6, 1987

[54] CEILING FAN MOUNTED CLOSE TO CEILING

[75] Inventors: Terrence L. Stanek, St. Louis County, Mo.; David R. Lathrop, Madison County, Ill.

[73] Assignee: Emerson Electric Co., St. Louis, Mo.

[21] Appl. No.: 715,000

[22] Filed: Mar. 22, 1985

[51] Int. Cl.[4] ..... F01D 29/60

[52] U.S. Cl. ..... 416/244 R; 416/170 R; 248/343

[58] Field of Search ..... 416/244 R, 246, 170 R, 416/170 C, 5; 248/324, 342, 343, 344, 345, 663, 674

[56] References Cited

U.S. PATENT DOCUMENTS

| | | | |
|---|---|---|---|
| 407,593 | 7/1889 | Hollings | 248/345 |
| 945,074 | 1/1910 | Bagley | 248/343 |
| 961,050 | 6/1910 | Wakefield | 248/343 |
| 981,039 | 1/1911 | Volk, Jr. | 248/343 |
| 1,487,892 | 3/1924 | Ryden | 248/343 |
| 4,064,427 | 12/1977 | Hansen et al. | 416/5 |
| 4,410,160 | 10/1983 | Alperin et al. | 248/674 |
| 4,448,388 | 5/1984 | Dennis et al. | 248/324 X |

OTHER PUBLICATIONS

Casablanca Fan Company catalog, 1984, pp. 1, 2, 25, 34, 35.

*Primary Examiner*—Leonard E. Smith

*Attorney, Agent, or Firm*—Polster, Polster and Lucchesi

[57] ABSTRACT

A system for mounting a ceiling fan is disclosed in which the ceiling fan is mounted relatively close to the ceiling of a conventional residential room having a ceiling height of about eight feet, in which the rotational plane of the fan blades is about seven or more feet from the floor.

7 Claims, 10 Drawing Figures

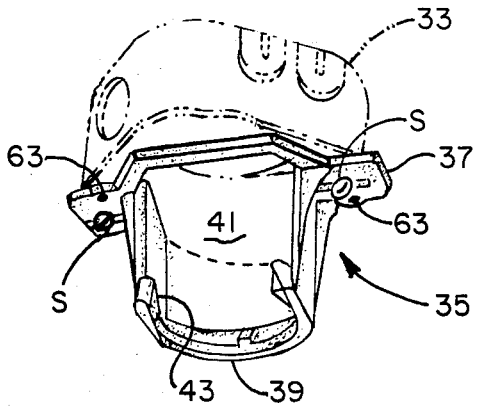
FIG. 4.
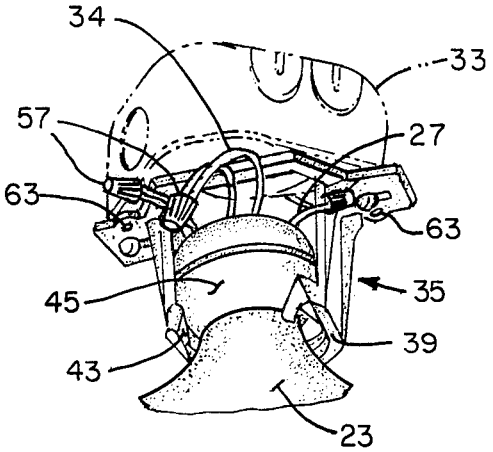
FIG. 5.
FIG. 6.
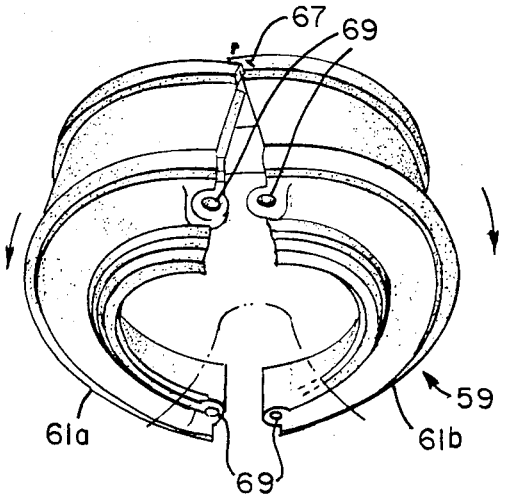
FIG. 7.
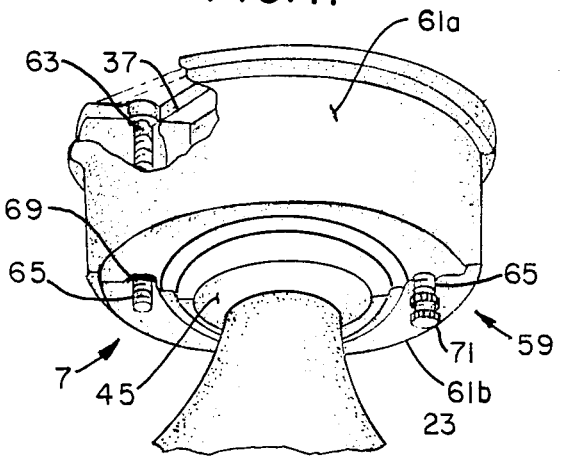
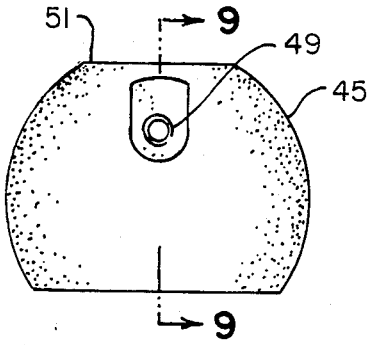
FIG. 8.
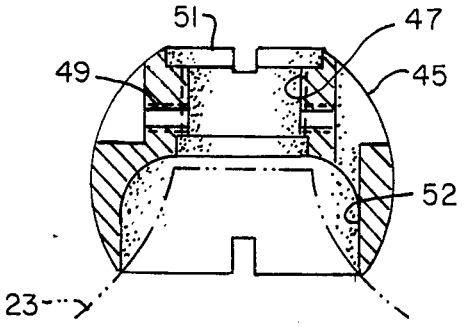
FIG. 9.

CEILING FAN MOUNTED CLOSE TO CEILING

BACKGROUND OF THE INVENTION

This invention relates to overhead ceiling fans, and more particularly to a system of mounting an overhead ceiling fan to an electrical junction box, such as may be typically installed in the ceiling of a residential room (or other room) which typically may have a ceiling height from the floor of about eight feet (2.4m.).

In recent years, overhead ceiling fans have again come into widespread use for circulating air within a room. In summer, operation of a ceiling fan will cause a gentle air flow within the room, which will substantially increase cooling and ventilation. In the winter, particularly if the fan is operated to move heated air downwardly from the ceiling, overhead ceiling fans have been found to be effective in more evenly distributing the heated air within the room, thus reducing heating requirements.

Generally, overhead ceiling fans are suspended from the ceiling by attaching them to an electrical junction box securely mounted within the ceiling. This junction box typically has power leads extending thereto for supplying conventional house current to the fan. Because of rotational imbalance loads and vibrations which may be present in the fan, it is conventional practice to hang the ceiling fan from the junction box in such manner that the fan is free, within a limited angular range, to be self-aligning with respect to the junction box thereby to allow the fan to assume its optimum operating position and to reduce or minimize stresses placed on ceilings and junction boxes. In many prior designs, the mounting of the fan to the electrical box was done by means of a J-hook, carried by the fan motor assembly, which engaged a bar carried by the electrical junction box. Typically, the J-hook was attached to a pipe extension such that the fan motor assembly extending down below the junction box a considerable distance. While these mounting systems were effective in reducing stresses, the fan's inherent tendency to wobble was increased.

To overcome this wobbling problem, ball and socket mounting systems became conventional which utilized a ball member secured to the end of the pipe extension. The ball was then socketed in a bracket carried by the electrical box such that the fan motor was free to rotate relative to the electrical box so that it was able to assume its equilibrium operating. These ball and socket mounting systems were successful in reducing wobble in that the wobble loads were damped by the friction of the ball sliding on its socket.

However, one common trait of such J-hook and prior ball and socket mounting arrangements has been the fact that an extension pipe was required between the motor assembly and the J-hook or ball member. This extension pipe posed a problem in mounting overhead ceiling fans on a residential ceiling which may, for example, have a floor-to-ceiling height of about eight feet (2.4m.). It will be appreciated that a relatively hazardous situation may be presented if the fan blades protruded below the ceiling to a level where they may come into contact with persons of average height walking under the fan. Generally, the plane of rotation of the ceiling fan blades should have a minimum height from the floor of about seven feet (2.1m.).

Heretofore, other so-called "close to the ceiling'-'mounting systems were commercially available, but these prior systems could not mount the fan blades sufficiently close to a residential eight-foot (2.4m.) ceiling such that at least seven feet (2.1m.) of clearance existed below the blades and such that wobbling of the fan (by means of a ball and socket mounting) was available.

Thus, there has been a long standing need for a ball swivel mounting system for an overhead ceiling fan which minimized the distance between the ceiling and the plane of rotation of the fan blades so as to maximize the distance from the floor to the fan blades.

SUMMARY OF THE INVENTION

Among the several objects and features of the present invention may be noted the provision of a ceiling fan which may be mounted close to the ceiling so as to minimize the distance between the plane of rotation of the fan blades and the ceiling;

The provision of such a mounting system in which the fan is free to swivel relative to its mounting about an generally vertical axis within a limited range so as to be self-aligning and so as to effectively supress the tendency of the fan to wobble and to protect the ceiling and junction box from damage;

The provision of such a mounting system for a ceiling fan which permits the ready connection of the fan motor lead wires to the power leads once the fan has been mounted from the ceiling.

The provision of such a mounting system in which the mounting can be hidden by a cover installed after the fan is mounted, with the cover requiring no substantial additional vertical room for installation; and The provision of such a mounting system for a ceiling fan which is easy to install, which is of rugged construction, and which securely mounts the ceiling fan on the ceiling.

Other objects and features of this invention will be in part apparent and in part pointed out hereinafter.

Briefly stated, a ceiling fan has a motor assembly which, when in its operating position, has a fan axis which is disposed generally vertically. The fan is intended to be mounted in a room having a ceiling and a floor. The ceiling fan has one or more fan blades rotatably driven by the fan motor for rotation about the fan axis in a generally horizontal fan blade plane. The fan motor assembly has a body, with the latter having an opening in the top thereof, this opening being generally coaxial with the fan axis. The motor further has a plurality of motor lead wires passing through this opening, with the lead wires being adapted to be connected to a source of electrical power provided in the ceiling. The ceiling is provided with an electrical junction box which is rigidly mounted within the ceiling, and the junction box has electrical power leads provided therein for connection to the motor lead wires. Specifically, this invention relates to means for mounting the ceiling fan relatively close to the ceiling such that in a conventional room having a floor-to-ceiling distance of about eight feet (2.4m.), a height of at least seven feet (2.4m.) is provided between the floor and the fan blade plane. This mounting means comprises a tubular hanger having a threaded outer surface, with one end of the hanger being threaded into the opening in the body of the fan motor assembly, and with the motor lead wires extending through the hanger. A ball has an internally threaded aperture extending therethrough which threadingly receives a portion of the hanger extending out beyond the fan motor assembly body such that the ball and the body are in substantial abutting relation with one another. A bracket having a base is secured to the electrical junction box, and the bracket has a socket spaced downwardly from the base. This socket is open on one side so as to permit the ball to be installed therein, with the ball being rotatably supported by the socket such that the motor assembly is self-aligned with respect to the bracket, and with the motor axis being generally vertical.

BRIEF DESCRIPTION OF THE DRAWINGS

FIG. 4 is a perspective view of a mounting bracket secured to an electrical junction box (shown in phantom) mounted within the ceiling;

FIG. 5 is view similar to FIG. 4 having the fan motor with the ball, generally as shown in FIG. 3, installed within the bracket, and having motor lead wires electrically connected to power lead wires provided within the electrical junction box;

FIG. 6 is a perspective view of a cover assembly which can be secured to the hanging bracket in such manner that the bracket is enclosed therewithin, and in such manner that little or no additional vertical space beyond the height of the cover is required for installation of the cover;

FIG. 7 is a view of the cover installed on the bracket, with portions of the cover broken away to show the method of mounting the cover;

FIG. 8 is an enlarged side elevational view of the ball member;

FIG. 9 is a cross sectional view of the ball, taken along line 9—9 FIG. 8.

Corresponding reference characters indicate corresponding parts throughout the several views of the drawings.

DESCRIPTION OF A PREFERRED EMBODIMENT

Figure 10:
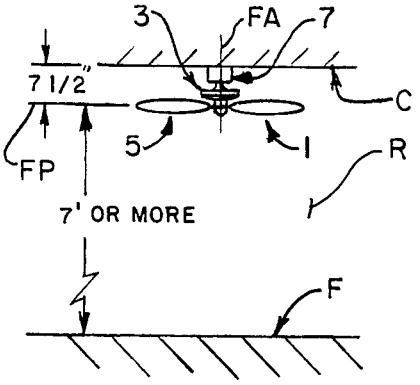
FIG. 10 (sheet 1) is a view of a ceiling fan suspended from a conventional residential ceiling, utilizing a mounting system of the present invention, such that the distance from the floor to the plane of rotation of the fan blades exceeds seven feet (2.1m.).

Referring now to the drawings, and particularly to FIG. 10, a ceiling fan assembly, as generally indicated at 1, is mounted on the ceiling C of a room R. The ceiling fan includes a motor assembly 3 driving a fan blade assembly 5, with the fan blade assembly being rotatable about a fan axis FA, and with the blades rotating in a horizontal fan blade plane FP. The room R illustrated in FIG. 10 is a conventional residential room or the like, having a floor-to-ceiling height of approximately eight feet (2.4m.). In accordance with this invention, means 7 is provided for mounting ceiling fan assembly 1 in relatively close proximity to the ceiling such that the distance from the floor to the fan blade plane FP exceeds seven feet (2.1m.) or more. More particularly, in typical installation, the ceiling fan mounting means 7 permits a conventional ceiling fan, such as a model CF30421 ceiling fan, manufactured by the assignee of the present invention, Emerson Electric Co., to be mounted such that the rotational plane FP of the fan blades is located within about seven and one-half inches (19 cm.) of the ceiling C.

Figure 1:
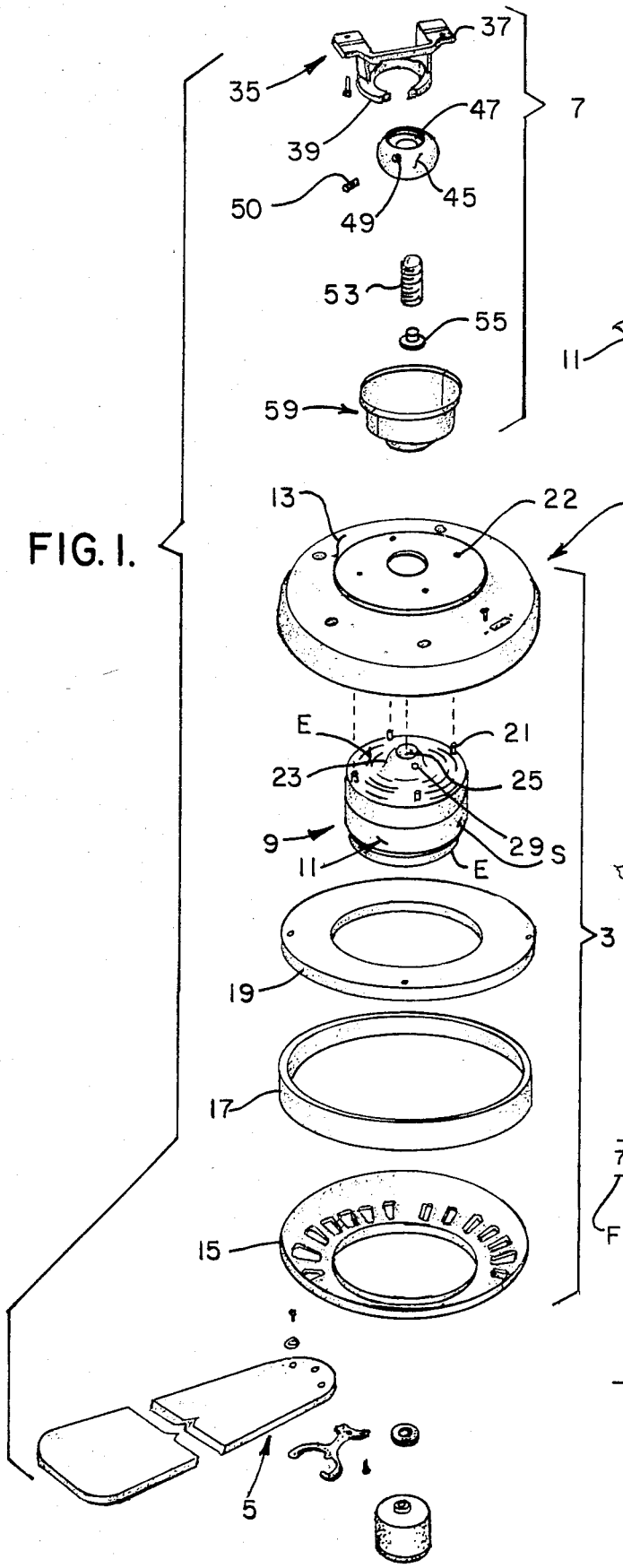
FIG. 1 is an exploded view of a ceiling fan and a mounting assembly of the present invention.

Referring now to FIG. 1, motor assembly 3 is shown to comprise a multi-pole electrical motor 9, having a motor housing 11, including an end shield E at each thereof, and a shell S surrounding the stator of the motor between the end shields at opposite ends of the stator. Motor housing 11 is enclosed within a decorative housing which includes a top fan housing 13, a bottom fan housing 15, and a belly band housing 17. As is conventional, a foam filter 19 may be disposed within the fan decorative housing surrounding the motor. Within the broader aspects of this invention, fan motor assemblies of other constructions can readily be utilized. The decorative fan housing is secured to motor housing 11 by means of throughbolts 21, which extend out beyond the upper end shield, as shown in FIG. 1, and which are received in mating holes 22 provided in top fan housing 13. Elongate bolts (not shown) secure the top and bottom fan housings to one another. Typically, the upper end shield E may have a boss 23 centrally located therewithin, with this boss extending axially out beyond the upper end face of the motor, and having a central threaded opening 25 through which motor lead wires 27 may pass. Boss 23 is provided with a threaded set screw opening 29 which receives a set screw 31 for purposes as will appear. It will be understood that boss 23 serves as the main mounting member for mounting fan motor assembly 3 from the ceiling C utilizing mounting means 7, as will be hereinafter described.

As shown in FIGS. 4 and 5, an electrical junction box 33 (shown in phantom) is securely mounted within ceiling C and, as is typical, electrical power leads 34 are run through the ceiling and terminate within box 34.

Mounting means 7 is shown to comprise a mounting bracket 35 having a base 37 adapted to be rigidly secured to electrical junction box 33. The bracket 35 further has a socket portion 39, which extends downwardly from base 37, with the socket having an open face or side 41 and a socket support 43. Further, mounting means 7 includes a ball member 45, which is adapted to be rigidly secured to motor boss 23 in a manner as will appear. More specifically, ball 45 has a central threaded opening 47 extending therethrough, and is provided with a threaded set screw opening 49 for receiving a set screw 50. Ball 47 has a flat upper end 51, and has a cavity 52 extending into the ball from its bottom, as shown in FIG. 9.

Mounting means 7 further comprises a hollow tubular hanger 53, having external threads. A bushing 55 of synthetic resin material is adapted to be inserted into the lower end of hanger 53 to protect lead wires 27 as they are inserted upwardly through hanger 53, as shown in FIG. 2.

Figure 2:
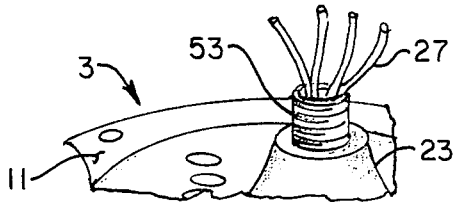
FIG. 2 is a fragmental view of the upper center portion of the fan motor assembly, illustrating an extension boss on its upper face, and illustrating a hanger threadably secured to an opening provided within the boss.

Referring now to FIG. 2, the lower end portion of hanger 53, with bushing 55 inserted therein, is threaded into the central opening 25 of boss 23 on the upper end shield E of fan motor 9, such that the upper portion of the hanger protrudes above the upper end of the boss, and such that the lead wires 27 extend through the tubular hanger. Then, with ball 45 in its position as shown in FIG. 9, the upper end of hanger 53 is threaded into the central threaded opening 47 of ball 45 from below, such that the inner or base face of cavity 52 is brought into firm abutting relation with the uppe end of boss 23. In this manner, it will be seen in FIG. 9 that a portion of the upper end of the motor boss 23 is received within cavity 52 thereby to minimize the overall height of the motor assembly 9 and the mounting means 7. Set screws 31 and 50 may be utilized to lock the hanger relative to the motor boss and to lock the ball relative to the upper portion of the hanger member.

Figure 3:
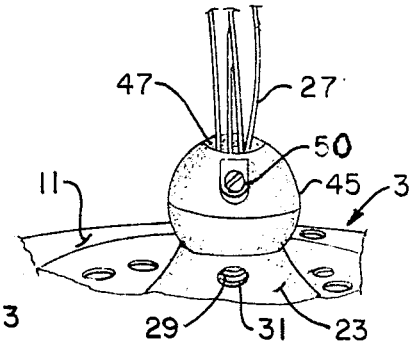
FIG. 3 is a view similar to FIG. 2 illustrating a ball member threadably secured to the upper end of the hanger, as illustrated in FIG. 2, with the ball being in substantial abutting relation with the boss.

With bracket 35 secured to electrical junction box 33 by screws S, as shown in FIG. 4, with ball 45 attached to hanger 53 in the manner shown in FIG. 3, and with lead wires 27 extending out through the top of the ball, the motor assembly 3 is lifted up near the ceiling, and the ball 45 is inserted sidewise into space 41 between the base 37 of bracket 35 and socket support 43. By lowering the motor assembly, socket support 43 will engage the lower portion of ball 45 so as to support the motor assembly by a ball-in-socket connection such that the motor assembly is free to self-align itself with bracket 35 such that the fan axis FA of the motor is generally perpendicular.

With lead wires 27 extending out through the top of the ball 45, electrical power leads 34 are drawn out of electrical junction box 33, and the appropriate connections between the power leads and the motor lead wires are made by securing wire nuts 57 to the junction of the lead wires and the power leads. Then, the lead wires are stuffed back inside the junction box.

In this manner, it can be seen that ball 45 can be readily secured to motor boss 23 in such manner that a minimum distance is required between the top of the motor and the ball. Also, it is a relatively easy matter to insert the ball affixed to the motor boss into bracket 35, and to make the motor lead wire to power supply leads connections. In one application, the distance between the top of the ceiling and the fan blade plane FP may be about seven and one-half inches (19 cm.). Thus, for a conventional room R, having a floor-to-ceiling height of eight feet, the distance between the floor and the fan blades may be seven feet, four and one-half inches, or more, thus providing adequate clearance between the fan blades 5 and a person of even considerably above average height walking therebeneath. Further, the ball and socket mounting system of the present invention tends to damp wobble force and, like prior ball and socket mounting systems, results in steady operation of the fan while reducing its mounting distance from the ceiling.

It will further be appreciated that an elongate extension pipe (not shown) may be substituted for hanger 53 such that in applications hwere it is not necessary for the fan to be close to the ceiling, the fan can be suspended in a conventional fashion. In these applications, it is preferred that ball 45 be inverted from its position, as shown in FIG. 9.

Additionally, it is conventional to provide a cover or enclosure to enclose mounting bracket 35 and the electrical connections between the motor and the power supply leads. Typically, these covers were constituted by a cone-shaped metal piece, having its smaller end projecting downwardly and being threaded onto an elongate extension pipe between an electrical junction box bracket and the fan motor. With the ball socketed in the bracket, the conical-shaped cover is slid upwardly along the extension pipe (not shown) so that it fits flush with the ceiling enclosing the bracket. The cone-shaped cup may be secured in place by means of a set screw engageable with the extension pipe. However, it is not possible to use such closures with ceiling mounting means 7 inasmuch as there is no elongate extension pipe along which the cover may be slid such that the cover is clear of the ball and bracket during initial mounting of the ball into the bracket, and during connection of the lead wires to the power leads.

Accordingly, further in accordance with this invention, a cover assembly, as generally indicated at 59, is provided which can be installed around bracket assembly 35 after motor assembly 3 has been socketed in socket 39 of bracket 35 in the manner heretofore described without the requirement of having an elongate pipe along which the cover assembly can slide. More specifically, cover assembly 59 includes two part-cylindrical cover halves 61*a*, 61*b* which, when fitted together, have their upper ends in generally flush abutting relation with ceiling C, which have cylindrical side wall portions of sufficient length to enclose bracket 35, and which have a lower central opening surrounding a portion of the lower face of ball 45 such that the bracket is totally enclosed therewithin, and yet such that motor assembly 3 is free to self-align itself with respect to bracket 35 such that the fan axis FA is generally vertically disposed.

Referring to FIG. 5, base 37 of bracket 35 is provided with threaded openings 63 into which elongate threaded studs 65, as shown in FIG. 7, may be threadably inserted. Then, the cover halves 61*a*, 61*b* are assembled around bracket 37 by interlocking tabs 67 on the upper ends of the mating surfaces of the part-circular ceiling cover portions and by bringing the stud receiving apertures 69 on the lower faces of the cover halves into axial alignment with one another, with the apertures 69 disposed just below the lower ends of studs 65. Then, the assembled cover assembly is raised a short distance (e.g., 0.75 inches or less) such that the studs 65 are received in apertures 69. Cap nuts 71 are then secured to the lower ends of the threaded studs 65 so as to securely hold the cover in place relative to the ceiling. In this manner, cover 59 may be installed around bracket 35 after fan motor assembly 3 has been suspended therefrom by mounting means 7 such that no substantial amount of additional vertical space is required for mounting cover 59 or for permitting connection of motor lead wires 27 to power leads 34.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. In a ceiling fan having a motor assembly which, when in its operating position, has a fan axis disposed generally vertically with said fan suspended from said ceiling, said ceiling fan being intended to be mounted in a room having a ceiling and a floor, said ceiling fan having one or more fan blades rotatably driven by said motor assembly for rotation about said fan axis in a generally horizontal fan blade plane, said motor assembly having a body, the latter having an opening in the top thereof, said opening being generally coaxial with said fan axis, a plurality of motor lead wires passing through said opening, said lead wires being adapted to be connected to a source of power in said ceiling for engergization of said motor assembly, said power source comprising an electrical box rigidly mounted within said ceiling and having said electrical leads therein for connection to said motor lead wires, wherein the improvement comprises: means for mounting said ceiling fan relatively close to said ceiling such that said fan blade plane within about one foot (0.3m.) of said ceiling, said mounting means comprising a tubular hanger having a threaded outer surface, one end of said hanger being threaded into said opening of said motor body with said motor lead wires extending through said hanger, a ball having an internally threaded aperture extending therethrough, said ball aperture threadably receiving a portion of said hanger extending out beyond said body said such that said ball and motor body are substantially in abutting relation with one antoher, a bracket having a base securable to said electrical box and a socket spaced downwardly from said base, said socket being open on one side so as to permit said ball, while affixed to said motor assembly, to be inserted within said socket, said ball being supported by said socket such that said motor assembly is self-aligned with respect to said bracket with said motor axis being generally vertical, wherein said ball has a cavity in the portion thereof proximate said motor assembly, and wherein said motor assembly has a boss protruding upwardly, said boss having said opening therein, at least a portion of said boss being received within said ball cavity so as to minimize the distance between the ceiling and the fan blade plane.

2. In a ceiling fan having a motor assembly which, when in its operating position, has a fan axis disposed generally vertically with said fan suspended from said ceiling, said ceiling fan being intended to be mounted in a room having a ceiling and a floor, said ceiling fan having one or more fan blades rotatably driven by said motor assembly for rotation about said fan axis in a generally horizontal fan blade plane, said motor assembly having a body, the latter having an opening in the top thereof, said opening being generally coaxial with said fan axis, a plurality of motor lead wires passing through said opening, said lead wires being adapted to be connected to a source of power in said ceiling for energization of said motor assembly, said power source comprising an electrical box rigidly mounted within said ceiling and having said electrical leads therein for connection to said motor lead wires, wherein the improvement comprises: means for mounting said ceiling fan relatively close to said ceiling such that in a conventional room having a distance between the floor and the ceiling of about eight feet (2.4 m.), a height of at least seven feet (2.1 m.) is provided between the floor and said fan blade plane, said mounting means comprising a tubular hanger having a threaded outer surface, one end of said hanger being threaded into said opening of said motor body with said motor lead wires extending through said hanger, a ball having an internally threaded aperture extending therethrough, said ball aperture threadably receiving a portion of said hanger extending out beyond said body such that said ball and motor body are substantially in abutting relation with one another, a bracket having a base securable to said electrical box and a socket spaced downwardly from said base, said socket being open on one side so as to permit said ball, while affixed to said motor assembly, to be inserted within said socket, said ball being supported by said socket such that said motor assembly is self-aligned with respect to said bracket with said motor axis being generally vertical, said fan further comprising a cover assembly enclosing said bracket and at least a portion of said ball, said bracket base having a pair of threaded openings therein, a threaded stud being installed in each of said threaded openings, said cover assembly comprising a pair of generally part-cylindrical cover portions, said cover portions having means thereon for permitting assembly of said cover assembly around said bracket and ball, and for receiving said studs for securement of said cover assembly to said bracket without the requirement of substantial vertical movement of the cover assembly relative to the motor during installation thereof.

3. In a ceiling fan having a motor assembly which , when in its operating position, has a fan axis disposed generally vertically with said fan suspended from said ceiling, said ceiling fan being intended to be mounted in a room having a ceiling and a floor, said ceiling fan having one or more fan blades rotatably driven by said motor assembly for rotation about said fan axis in a generally horizontal fan blade plane, said motor assembly having a body, the latter having an outwardly protruding boss, said boss having an opening in the top thereof, said opening being generally coaxial with said fan axis, a plurality of motor lead wires passing through said opening, said lead wires being adapted to be connected to a source of power in said ceiling for energization of said motor assembly, said power source comprising an electrical box rigidly mounted within said ceiling and having said electrical leads therein for connection to said motor lead wires, wherein the improvement comprises: means for mounting said ceiling fan relatively close to said ceiling such that said fan blade plan is spaced within about one foot (0.3 m.) of said ceiling, said mounting means comprising a tubular hanger having a threaded outer surface, one end of said hanger being threaded into said opening of said motor body with said motor lead wires extending through said hnager, a ball having recess therein and an internally threaded aperture extending therethrough, said ball aperture threadably receiving a portion of said hanger extending out beyond said boss such that with said ball threaded onto said hanger, at least a portion of said boss is received in said recess and such that said ball and motor body are substantially in abutting relation with one another, a one-piece bracket having a base securable to said electrical box and a socket spaced downwardly from said base, said socket being open on one side so as to permit said ball, while affixed to said motor assembly, to be inserted within said socket, said ball being supported by said socket such that said motor assembly is self-aligned with respect to said bracket with said motor axis being generally vertical.

4. In a ceiling fan as set forth in claim 3 wherein said socket is positioned from said base a distance sufficient to permit connection of said motor lead wires to said power leads with said fan assembly supported by said ball on said socket.

5. In a ceiling fan as set forth in claim 3 wherein said electrical box has a plurality of fastener openings therein, and wherein said bracket base has at least two apertures adapted to mate with two respective openings in said electrical box such that said bracket may be rigidedly secured to said electrical box via screws inserted into said apertures and receives in said openings.

6. In a ceiling fan as set forth in claim 3 further comprising means for locking said hanger with respect to said motor assembling body, and means for locking said hanger with respect to said ball.

7. In a ceiling fan as set forth in claim 6 wherein said locking means comprises set screws.

* * * * *